United States Patent [19]

Sugimoto et al.

[11] Patent Number: 4,475,875

[45] Date of Patent: Oct. 9, 1984

[54] SCROLL TYPE FLUID DISPLACEMENT APPARATUS WITH BALANCE WEIGHT

[75] Inventors: Kazuo Sugimoto, Maebashi; Kiyoshi Terauchi, Isesaki, both of Japan

[73] Assignee: Sanden Corporation, Gunma, Japan

[21] Appl. No.: 433,898

[22] Filed: Oct. 12, 1982

[30] Foreign Application Priority Data

Oct. 12, 1981 [JP] Japan ..... 56-162211

[51] Int. Cl.[3] ..... F01C 1/02; F01C 17/06; F01C 21/00

[52] U.S. Cl. ..... 418/55; 418/151

[58] Field of Search ..... 418/55, 59, 151

[56] References Cited

U.S. PATENT DOCUMENTS

| | | | |
|---|---|---|---|
| 1,098,458 | 6/1914 | Nelson | 418/59 |
| 2,684,036 | 7/1954 | Stratveit | 418/151 |
| 3,874,827 | 4/1975 | Young | 418/151 |
| 3,994,636 | 11/1976 | McCullough et al. | 418/55 |
| 4,278,409 | 7/1981 | Eiermann | 418/151 |

*Primary Examiner*—John J. Vrablik

*Attorney, Agent, or Firm*—Banner, Birch, McKie & Beckett

[57] ABSTRACT

A scroll type fluid displacement apparatus is disclosed, which includes a housing having a front end plate and a cup shaped casing. A fixed wrap extends into an operative interior area of the casing from an inner end surface of an end plate portion of cup shaped casing. An orbiting scroll has an end plate from which an orbiting wrap extends, and a tubular member axially projects from the end surface of end plate into the operative interior area of the casing. The tubular member has a hollow interior at its center. A drive shaft is rotatably supported by the front end plate and a crank pin extends from its inner end surface. The crank pin is rotatably carried within the hollow interior of the tubular member through a bearing to thereby rotatably support the orbiting scroll. A balance-weight is fixed on the axial end portion of the crank pin to cancel the dynamic unbalance caused by the centrifugal force of the orbital moving parts.

4 Claims, 2 Drawing Figures

SCROLL TYPE FLUID DISPLACEMENT APPARATUS WITH BALANCE WEIGHT

BACKGROUND OF THE INVENTION

This invention relates to a fluid displacement apparatus, and more particularly, to a scroll type fluid displacement apparatus for use as a supercharger for an engine or as an air pump.

Scroll type fluid displacement apparatus are well known in the prior art. For example, U.S. Pat. No. 801,182 (Creux) discloses a fluid displacement device including two scrolls, each having a circular end plate and a spiroidal or involute spiral element. These scrolls are maintained angularly and radially offset so that both spiral elements interfit to make a plurality of line contacts between their spiral curved surfaces to thereby seal off and define at least one pair of fluid pockets. The relative orbital motion of the scrolls shifts the line contacts along the spiral curved surfaces, and as a result, the volume of the fluid pockets changes. Since the volume of the fluid pockets increases or decreases dependent on the direction of the orbital motion, the scroll type fluid apparatus is applicable to compress, expand or pump fluids.

Scroll type fluid displacement apparatus have been used as refrigeration compressors in refrigerators or air conditioners. Such compressors need high efficiency and a high compression ratio, such as a 5 to 10 compression ratio. In such a compressor, the re-expansion volume, i.e., the smallest volume of the fluid pockets in the compression cycle, which is located at the center of the scrolls, must be reduced as much as possible. To this end, the inner end portions of the spiral elements are extended inwardly as far as possible to the center of the scroll.

The conventional driving mechanism in a high compression ratio scroll type compressor is connected to the end plate of an orbiting scroll on a side opposite the spiral element. The acting point of the driving force of the driving mechanism on the orbiting scroll generally is displaced from the acting point of the reaction force of the compressed gas, which acts at an intermediate location along the height of the spiral element of the orbiting scroll. If the distance between these acting points is relatively long, a moment is created which adversely effects the stability of the orbiting scroll during orbital motion. Therefore, to compensate for this loss of stability, the length of the spiral element generally is limited, which in turn limits the volume of the apparatus.

The above limitation on the length of the spiral element is not a problem for a scroll type fluid displacement apparatus which requires a compression ratio of only 1.0 to 1.5, since the re-expansion volume need not be reduced as much as in a high compression ratio apparatus. In an apparatus which requires only a low compression ratio, the difference in pressure between the high pressure space and the lower pressure space is smaller than in a high compression ratio apparatus, so that 1.5 to 2.0 revolutions of the spiral element generally is sufficient.

A scroll type fluid displacement apparatus generally has a balanceweight to cancel the dynamic imbalance caused by the centrifugal force of the orbital moving parts. The balanceweight is usually located on the drive shaft, so that the apparatus must have space to rotatably enclose the balanceweight within the apparatus. Therefore, the axial and radial dimensions of the apparatus are increased.

SUMMARY OF THE INVENTION

It is a primary object of this invention to provide an improved scroll type fluid displacement apparatus having a low compression ratio, which is simple to construct and can be simply and reliably manufactured.

It is another object of this invention to provide a scroll type fluid displacement apparatus with improved dynamic balance so that vibration of the apparatus is reduced.

A scroll type fluid displacement apparatus according to this invention includes a housing having a fluid inlet port and a fluid outlet port. A fixed scroll member is joined with the housing and has a first end plate from which a first wrap extends into an operative interior area of the housing. An orbiting scroll has a second end plate from which a second wrap extends. The first and second wraps interfit at an angular and radial offset to make a plurality of line contacts to define at least one pair of fluid pockets. A drive shaft is rotatably supported by the housing and has a crank pin extending from its inner end. The crank pin is rotatably received in a tubular member of the second end plate to thereby rotatably support the orbiting scroll. The crank pin is provided with a balanceweight at its inner end portion which extends outward from the tubular member.

Further objects, features and aspects of this invention will be understood from the following detailed description of preferred embodiments of this invention, referring to the annexed drawings.

DETAILED DESCRIPTION OF THE INVENTION

Figure 1:
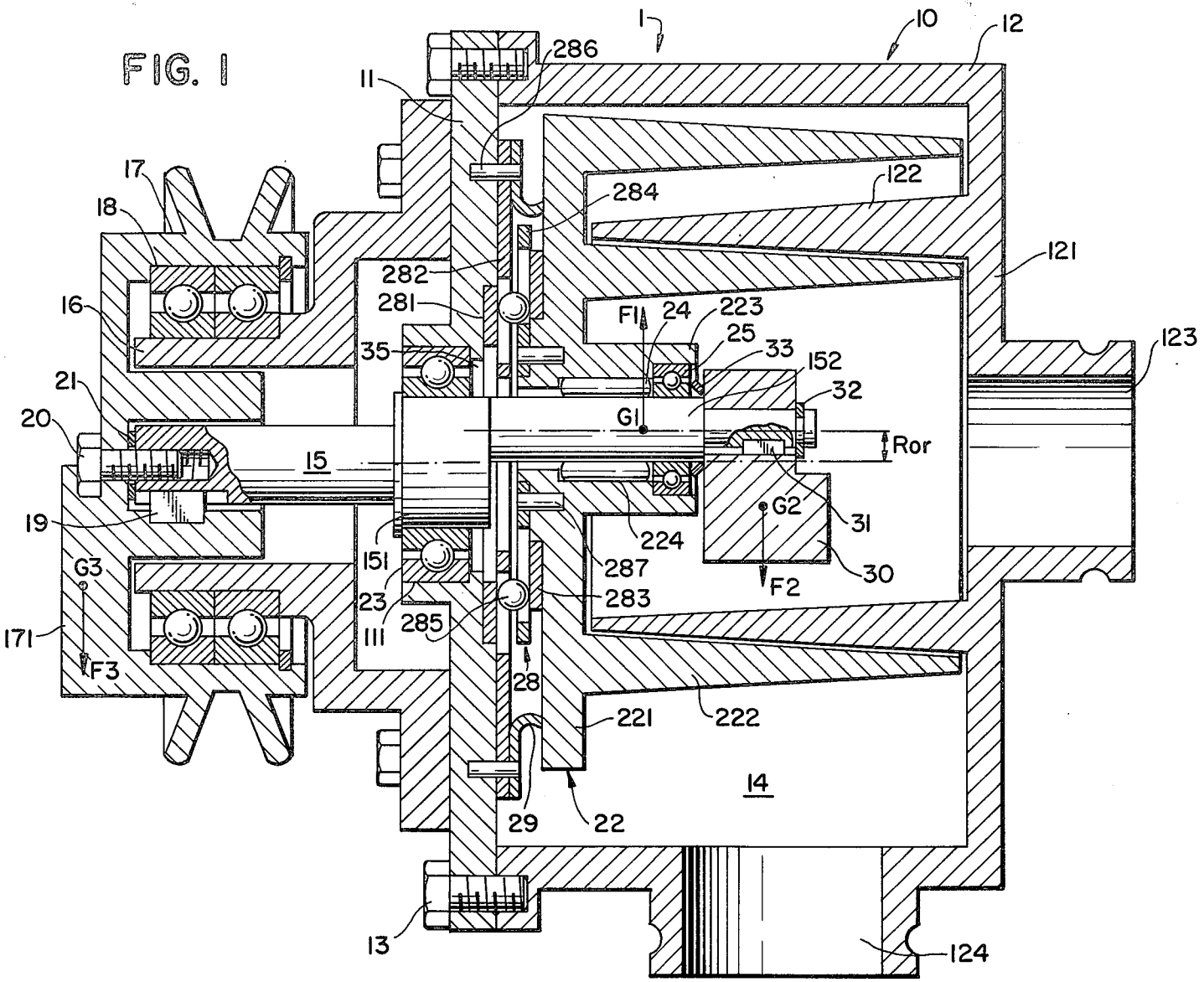
FIG. 1 is a vertical sectional view of a scroll type fluid displacement apparatus according to an embodiment of this invention.

Referring to FIG. 1, an embodiment of a fluid displacement apparatus in accordance with the present invention, in particular, a scroll type fluid displacement apparatus 1, is shown. Apparatus 1 includes housing 10 having a front end plate 11 and a cup shaped casing 12, which is attached to one end surface of front end plate 11 by a plurality of bolts 13. An opening in cup shaped casing 12 is covered by front end plate 11 to seal off an inner chamber 14 of cup shaped casing 12. An opening 111 is formed in the center of front end plate 11 for penetration or passage of a drive shaft 15. Front end plate 11 has an annular sleeve 16 projecting from the front end surface thereof which surrounds drive shaft 15. In the embodiment shown in FIG. 1, sleeve 16 is separate from front end plate 11. Therefore, sleeve 16 is fixed to the front end surface of front end plate 11 by bolts.

A pulley 17 is rotatably supported by a bearing 18 which is carried on the surface of sleeve 16. The outer end portion of drive shaft 15 is fixed to pulley 17 by a key 19, located within sleeve 16, and bolt 20 through shim 21. Bolt 20 extends axially inward from the axial end of drive shaft 15. Drive shaft 15 is driven by an external drive power source through pulley 17.

A fixed spiral element 122 is formed integral with an end plate portion 121 of cup shaped casing 12 and extends into inner chamber 14 of cup shaped casing 12 to form a fixed scroll. Spiral element 122, which has 1.5 to 2.0 turns or revolutions, has a trapezoidal shape as shown in FIG. 1. An outlet port 123 is formed through the end plate of cup shaped casing 12 and an inlet port 124 is formed through the outer peripheral surface of cup shaped casing 12.

An orbiting scroll 22 is also located within inner chamber 14 of cup shaped casing 12 and includes a circular end plate 221 and an orbiting wrap or spiral element 222 affixed to or extending from one side surface of circular end plate 221. Spiral element 222 also has a trapezoidal shape as shown in FIG. 1. A tubular member 223 projects axially from a generally central radial area of one side surface of end plate 221. Tubular member 223 extends axially a distance into the operative interior of cup shaped casing 12, and preferably to approximately the axial central area of spiral element 222, however, not beyond the axial end of spiral element 222. Fixed spiral element 122 and orbiting spiral element 222 interfit at an angular offset of 180° and a predetermined radial offset. At least a pair of fluid pockets are defined between spiral elements 122 and 222. Tubular member 223 has a hollow interior 224 extending through its center. Hollow interior 224 thus extends between the distal end of tubular member 223 at the axial central area of spiral elements 122 and 222 and the side surface of end plate 221 opposite to the side thereof from which spiral element 222 extends.

Drive shaft 15 has a disk shaped rotor 151 at its inner end portion which is rotatably supported by front end plate 11 through a bearing 23 located within opening 111 of end plate 11. A crank pin 152 projects axially from an axial end surface of disk shaped rotor 151 at a position which is radially offset from the center of drive shaft 15. Crank pin 152 is carried in hollow interior 224 of tubular member 223 by bearings 24 and 25. Crank pin 152 has an axial length which extends from its connection point with disk shaped rotor 151, through hollow interior 224, out of tubular member 223 and into the axial central area of the spiral elements 122 and 222. Bearing 24 is located adjacent end plate 221 and bearing 25 is located adjacent the distal end of tubular member 223. Bearings 24 and 25 are thus axially spaced from one another. Orbiting scroll 22 is thus rotatably supported by crank pin 152 at axial spaced locations through bearings 24 and 25.

A balanceweight 30 is placed on the axial outer end portion of crank pin 152, which extends outward from tubular member 223, in order to cancel the dynamic imbalance caused by the centrifugal force of orbiting scroll 22. Balanceweight 30 is fixed on crank pin 152 by a key 31 and the axial movement thereof is prevented by a snap ring 32 attached on a shoulder portion of crank pin 152 at its outer end. A spring washer 33 is placed between balanceweight 30 and bearing 25 to push orbiting scroll 22 against front end plate 11. Pulley 17 also is provided with a balanceweight 171. In the embodiment shown in FIG. 1, balanceweight 171 is formed integral with pulley 17 at a position which is angularly offset from crank pin by 180°.

A rotation preventing/thrust bearing device 28 is located between the inner end surface of front end plate 11 and an axial end surface of circular end plate 221 of orbiting scroll 22. Rotation preventing/thrust bearing device 28 includes a fixed race 281 attached to the inner end surface of front end plate 11, a fixed ring 283 attached to the inner end surface of front end plate 11 by pins 286 to cover the end surface of fixed race 281, an orbiting race 282 attached to the end surface of circular end plate 221 of orbiting scroll 22, an orbiting ring 284 attached to the end surface of circular end plate 221 by pins 287 to cover the end surface of orbiting race 283, and a plurality of bearing elements, such as balls 285. A plurality of pockets or holes are formed through rings 282 and 284. Each ball 285 is placed in facing, generally aligned pockets. The rotation of orbiting scroll 22 is prevented by the interaction between balls 285 and the pockets; also the axial thrust load from orbiting scroll 22 is supported by front end plate 11 through balls 285.

A grease seal mechanism 29 is placed between the outer peripheral portion of circular end plate 221 or orbiting scroll 22 and the inner end surface of front end plate 11. Grease, which is enclosed within a sealed off space 35 between front end plate 11 and circular end plate 221 of orbiting scroll 22, is retained to lubricate bearings 24 and 25 and rotation preventing/thrust bearing device 28. Bearing 23 has a grease seal mechanism to prevent the leakage of grease.

Scroll type fluid displacement apparatus 1 operates in the following manner. Pulley 17 transmits rotation to drive shaft 15, which in turn orbits or revolves crank pin 152. Orbiting scroll 22 is connected to crank pin 152, and therefore, is also driven an orbital motion. The rotation of orbiting scroll 22 is prevented by rotation preventing/thrust bearing device 28. As orbiting scroll 22 orbits, the line contacts between both spiral elements 122 and 222 shift along the surfaces of the spiral elements. The fluid, introduced into the inner chamber 14 of cup shaped casing 12 through inlet port 124, is taken into the fluid pockets defined between the spiral elements. The fluid in fluid pockets is moved to the center from the external portion (or is moved to external portion from the center) by the orbital motion of orbiting scroll 22. The fluid introduced into the inlet port 124 is thereby discharged from outlet port 123 after compression in the fluid pockets, or vice versa in an expansion mode.

In this construction, the center of mass G1 of the orbital moving parts, including orbiting scroll 22 and bearings 24 and 25, is located on the axis of crank pin 152 and the centrifugal force F1 which arises because of the orbiting motion of the orbital moving parts is applied at this point. Drive shaft 15 is provided with a pair of balanceweights 30 and 171 to minimize the problems which would arise from this centrifugal force casued by the orbital motion of the orbiting moving parts. Balanceweight 30 is placed on the axial outer end portion of crank pin 152 and causes a centrifugal force F2 in the opposite direction to the centrifugal force F1 of the orbital moving parts when drive shaft 15 is rotated. The center of mass G2 of balanceweight 30 is axially offset from the center of mass G1 of the orbital moving parts. Therefore, a moment is created by difference in acting points of the centrifugal forces, to thereby cause vibration of the apparatus. To prevent the vibration caused by this moment, drive shaft 15 is provided with another balanceweight 171. Balanceweight 171 is placed on pulley 17 which is connected to the outer end portion of drive shaft 15 and causes a centrifugal force F3 in the same direction as the centifugal force F2 of balanceweight 30 when drive shaft 15 is rotated. The masses of both balanceweights 30 and 171 are selected so that the total centrifugal force of the balanceweights, i.e., F1+F2, is equal in magnitude to the centrifugal force F1 of the orbital moving parts.

As mentioned above, balanceweight 30 which cancels the dynamic imbalance caused by the centrifugal force of the orbiting parts is placed on the axial outer end portion of the crank pin 152, i.e., within the axial central area of spiral elements 122 and 222. Therefore, the space within which balanceweight 30 is diposed is negligible, i.e. it is in an interior space so that additional space, exterior of the scroll need not be created. The radial and axial dimensions of the apparatus is thus reduced, while attaining dynamic balance of the apparatus. Furthermore, the centrifugal force of the orbital moving parts is canceled by the centrifugal force of two balanceweights, therefore the magnitude of centrifugal force of balanceweight 30, which is placed on crank pin 152 is reduced, i.e. need not be too large. The mass of balanceweight 30 and the rotation radius of the center of mass of balanceweight 30 is thus also reduced.

Figure 2:
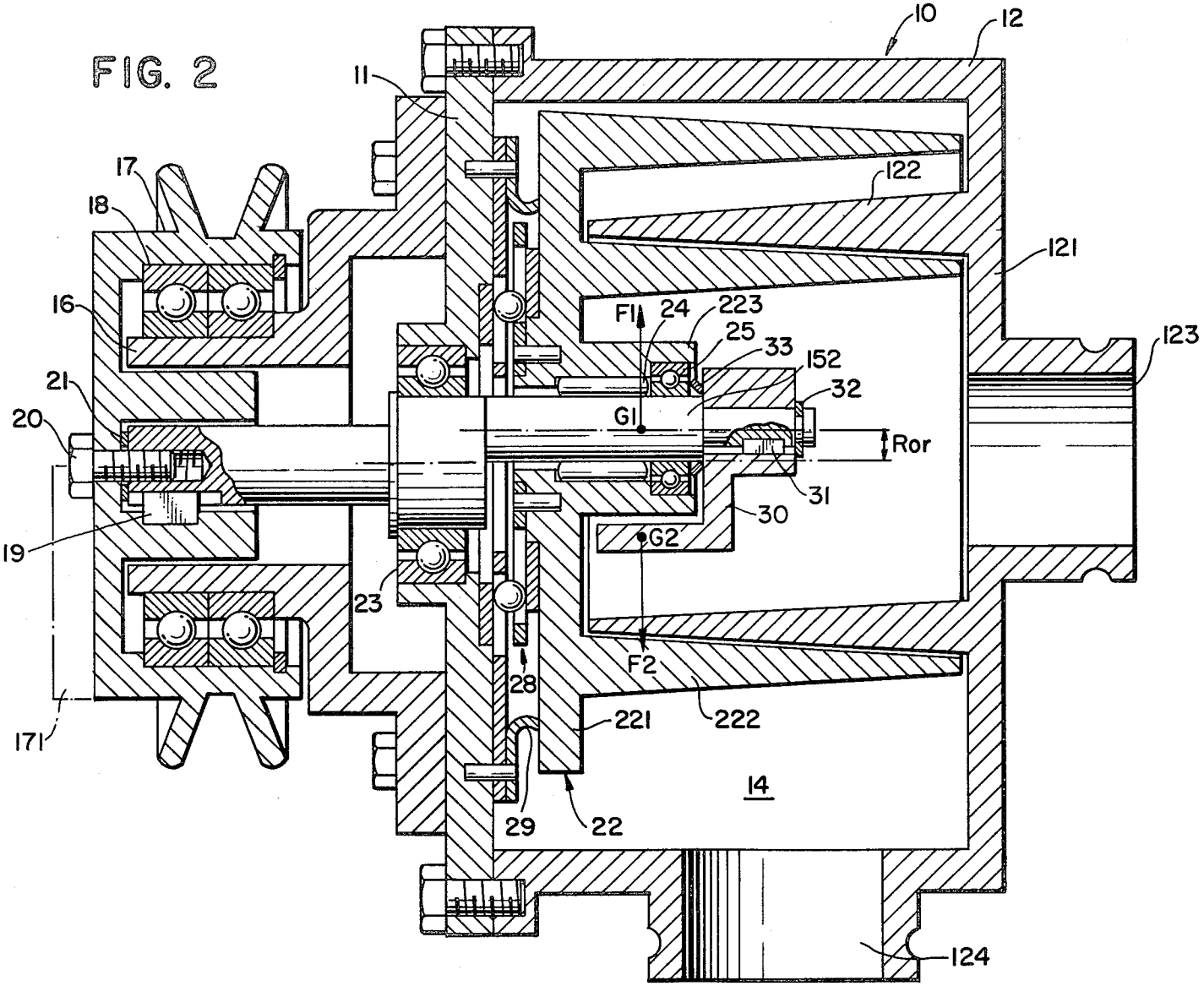
FIG. 2 is a vertical sectional view of a scroll type fluid displacement apparatus according to another embodiment of this invention.

FIG. 2 illustrates another embodiment of a scroll type apparatus wherein parts of the apparatus, which are similar to the parts of the apparatus shown in FIG. 1, are indicated by the same number.

In this embodiment the center of mass G2 of balanceweight 30 is disposed at the same axial position on crank pin 152 as the center of mass G1 of the orbital moving parts. Therefore, balanceweight 171, which is shown in dot-dash line in FIG. 2, can be omitted, because the moment created by the difference in acting points of the centrifugal forces is not present. Therefore, the apparatus design is simpler.

The invention has been described in detail in connection with preferred embodiments, but these are examples only and this invention is not restricted thereto. It will be easily understood by those skilled in the art that other variations and modifications can be easily made within the scope of this invention.

What is claimed:

1. In a scroll type fluid displacement apparatus including a housing having an inlet port and an outlet port, a fixed scroll joined with said housing and having a first end plate from which a first wrap extends into an operative interior area of said housing, an orbiting scroll having a second end plate from which a second wrap extends, said first and second wraps interfitting at an angular and radial offset to make a plurality of line contacts to define at least one pair of sealed off fluid pockets within said operative interior area, a driving mechanism, including a drive shaft rotatably supported by said housing, connected to said orbiting scroll to drive said orbiting scroll in an orbital motion, and rotation preventing means for preventing the rotation of said orbiting scroll so that the volume of the fluid pockets changes during the orbital motion of said orbiting scroll, the improvement comprising said driving mechanism including a crank pin axially projecting from an inner end of said drive shaft, said second end plate of said orbiting scroll having a centrally located opening, said crank pin being rotatably carried in said centrally located opening by a bearing and extending from said opening into a central area of said spiral elements, and a first balanceweight fixed on an axial outer end of said crank pin and located with said operative interior area of said housing to cancel dynamic unbalance caused by the orbiting motion orbital moving parts of the apparatus.

2. The scroll type fluid displacement apparatus of claim 1 wherein the center of mass of said first balanceweight is at the same axial location as the center of mass of the orbital moving parts.

3. The scroll type fluid displacement apparatus of claim 1 wherein the center of mass of said first balanceweight is axially offset from the center of mass of the orbital moving parts, and said drive shaft is provided with a second balanceweight at its axial outer end portion to prevent vibration caused by the motion of the orbital moving parts and the first balanceweight.

4. The scroll type fluid displacement apparatus of claim 2 wherein a rotor member is fixed on an axial outer end of said drive shaft and rotatably supported by said housing to transmit rotation to said drive shaft, and said second balanceweight is affixed to said rotor member.

* * * * *